US006551414B2

(12) United States Patent
Reichold

(10) Patent No.: US 6,551,414 B2
(45) Date of Patent: Apr. 22, 2003

(54) AUTOMATIC SYSTEM AND METHOD FOR REMOVING MINERAL DEPOSITS FROM A DISHWASHER

(75) Inventor: Kurt A. Reichold, Mukwonago, WI (US)

(73) Assignee: U.S. Chemical Corporation, Brookfield, WI (US)

( * ) Notice: Subject to any disclaimer, the term of this patent is extended or adjusted under 35 U.S.C. 154(b) by 199 days.

(21) Appl. No.: 09/766,441

(22) Filed: Jan. 19, 2001

(65) Prior Publication Data

US 2002/0096192 A1 Jul. 25, 2002

(51) Int. Cl.[7] ..... B08B 7/04

(52) U.S. Cl. ..... 134/18; 134/2; 134/10; 134/22.19; 134/57 D; 134/104.1; 134/102.2; 427/98; 165/303

(58) Field of Search ..... 134/2, 10, 22.19, 134/18, 104.1, 113, 570, 102.2; 427/98; 610/224; 165/303

(56) References Cited

U.S. PATENT DOCUMENTS

| | | | | | |
|---|---|---|---|---|---|
| 3,623,991 | A | * | 11/1971 | Sabatelli et al. | 134/2 |
| 3,903,909 | A | * | 9/1975 | Noren et al. | 134/113 |
| 4,011,101 | A | | 3/1977 | Levenback et al. | 134/10 |
| 4,086,929 | A | | 5/1978 | Focht | 134/56 |
| 4,209,343 | A | * | 6/1980 | Lane et al. | 134/102.2 |
| 4,509,543 | A | | 4/1985 | Livingston et al. | 134/57 |
| 5,458,851 | A | | 10/1995 | Schroeder et al. | 422/28 |
| 5,462,606 | A | * | 10/1995 | Burns | 134/18 |
| 5,545,259 | A | * | 8/1996 | Suzuki et al. | 134/18 |
| 5,558,841 | A | | 9/1996 | Nakagawa et al. | 422/105 |
| 5,670,467 | A | * | 9/1997 | Fleisher | 510/224 |
| 5,681,400 | A | | 10/1997 | Brady et al. | 134/18 |
| 5,820,689 | A | | 10/1998 | Tseng et al. | 134/3 |
| 6,103,017 | A | | 8/2000 | Thies et al. | 134/10 |
| 6,109,278 | A | | 8/2000 | Shindo et al. | 134/56 |
| 6,403,551 | B1 | * | 6/2002 | Caruthers, Jr. | 134/22.19 |
| 2002/0066555 | A | * | 12/2000 | Mulder | 165/303 |

FOREIGN PATENT DOCUMENTS

| | | | | |
|---|---|---|---|---|
| EP | 0118719 | * | 9/1984 | A47L/15/42 |
| EP | 0121631 | * | 10/1984 | C02F/5/10 |

OTHER PUBLICATIONS http://www.deconlabs.com/cleaning/descals.htm.*
http://choisy.com/Fiches_techniques/7013FT.pdf.*

* cited by examiner

*Primary Examiner*—Randy Gulakowski
*Assistant Examiner*—Gentle E Winter
(74) *Attorney, Agent, or Firm*—George E. Haas; Quarles & Brady LLP

(57) ABSTRACT

Whenever a dishwasher is operated a given number of times or whenever a given number of days transpire, an apparatus performs a process that removes minerals deposits that have built-up inside the dishwasher. The process commences by rinsing the dishwasher interior with water and draining the rinse water. A mixture of water and a chemical that dissolves the minerals is introduced into the dishwasher and a pump circulates the mixture inside the dishwasher for a period of time. Next the mixture is drained out and the dishwasher interior is rinsed again with fresh water.

18 Claims, 3 Drawing Sheets

AUTOMATIC SYSTEM AND METHOD FOR REMOVING MINERAL DEPOSITS FROM A DISHWASHER

BACKGROUND OF THE INVENTION

The present invention relates to automatic dishwashers, and in particular to the removal of mineral deposits from interior surfaces of dishwashers.

Dishwashers are commonly used in both residential and commercial kitchens to clean and sanitize dishes, glassware, and cooking utensils. A problem that plagues dishwashers is the build-up of mineral deposits, especially calcium oxide commonly known as lime, on the interior components of the machine. The magnitude of this problem depends upon the mineral content of the water supplied to the dishwasher and whether water softening has been employed. Lime build-up is more significant in commercial dishwashers due to the frequency of use and the amount of water passing through the equipment. The lime deposits, often referred to as lime scale, has a negative impact on the ability of a detergent to satisfactorily clean the kitchenware. In addition, such mineral deposits may adversely affect movement of various dishwasher components and the proper flow of water.

As a consequence of this problem, products have been developed to dissolve calcium deposits within dishwashers. However these products have to be applied manually. Thus a dishwasher operator must first become aware that mineral deposits have developed to a degree that requires treatment. This means that the operator has to periodically inspect the dishwasher components for scale build-up.

The de-scaling process involves manually filling an empty dishwasher with water, adding the de-scaling chemical, and operating the machine through a rinse cycle. The manual de-scaling may require a longer than the several rinse cycles depending upon the degree of mineral build-up. In severe cases the dishwasher components have to be scrubbed by hand. It is not uncommon for kitchen personnel to spend 20 to 30 minutes cleaning a heavily limed dishwasher.

SUMMARY OF INVENTION

The present invention provides an apparatus which automatically operates a dishwasher to perform a de-scaling function at times when the dishwasher will not be required for normal operation. Preferably, repeated de-scaling operations occur at specified intervals or upon occurrence of a predefined event.

The dishwasher has a water valve, a drain valve, and a wash pump. The novel apparatus includes a reservoir for containing a de-scaling chemical which cleanses mineral deposits from surfaces of objects. Preferably, the reservoir contains a sufficient amount of the chemical for several de-scaling operations. A flow control device couples the reservoir to the dishwasher and controls a flow of the de-scaling chemical into the dishwasher.

A controller is connected to operate the water valve, the drain valve, the wash pump and the control device. The occurrence of a predefined event causes the controller to begin a process that removes the minerals from inside the dishwasher. For example that predefined event may be whenever a given number of days or a specified number of wash cycles have occurred since the last time the mineral removal procedure was performed.

To carry out that process the controller operates the water valve and the control device to introduce water and the de-scaling chemical into the dishwasher. Then the wash pump is activated for a given period of time to circulate the mixture of water and the de-scaling chemical inside the dishwasher. Thereafter the drain valve is opened to remove the mixture from the dishwasher.

Preferably the interior of the dishwasher is rinsed with water before and after the removal of mineral deposits to prevent a reaction of the de-scaling chemical with other chemicals used to clean kitchen ware.

DETAILED DESCRIPTION OF THE INVENTION

Figure 1:
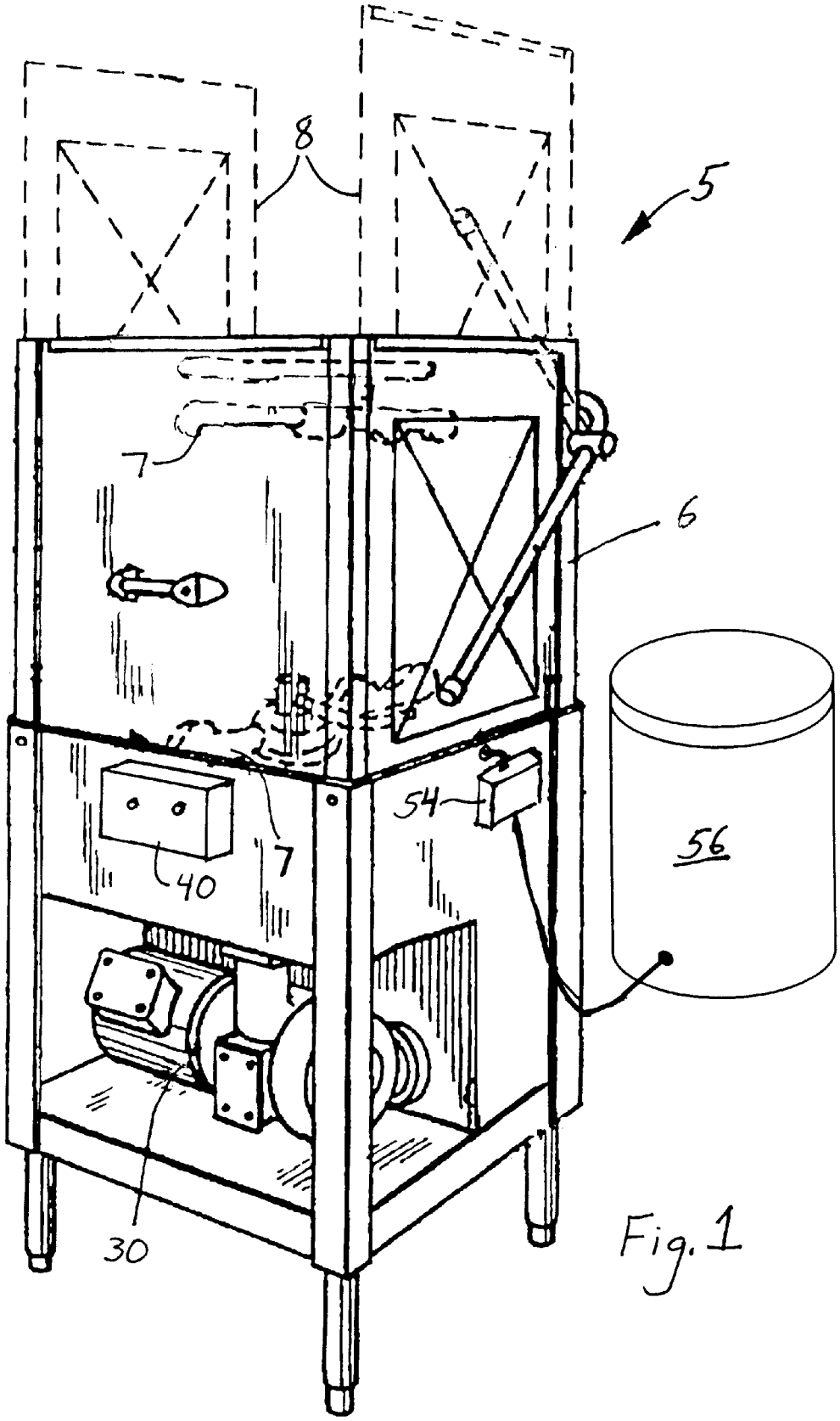
FIG. 1 Is an isometric illustration of a commercial dishwasher which incorporates the present invention.

With initial reference to FIG. 1, a commercial dishwasher 5 has a cabinet 6 defining an internal chamber into which glasses and dishes are placed for washing. Two doors 8 are slidably mounted on the cabinet 6 to close opening through which the glasses and dishes pass into and out of the interior chamber. The chamber contains a washing and rinsing apparatus that includes a plurality of nozzles 7 from which water supplied by a wash pump 30 sprays.

Figure 2:
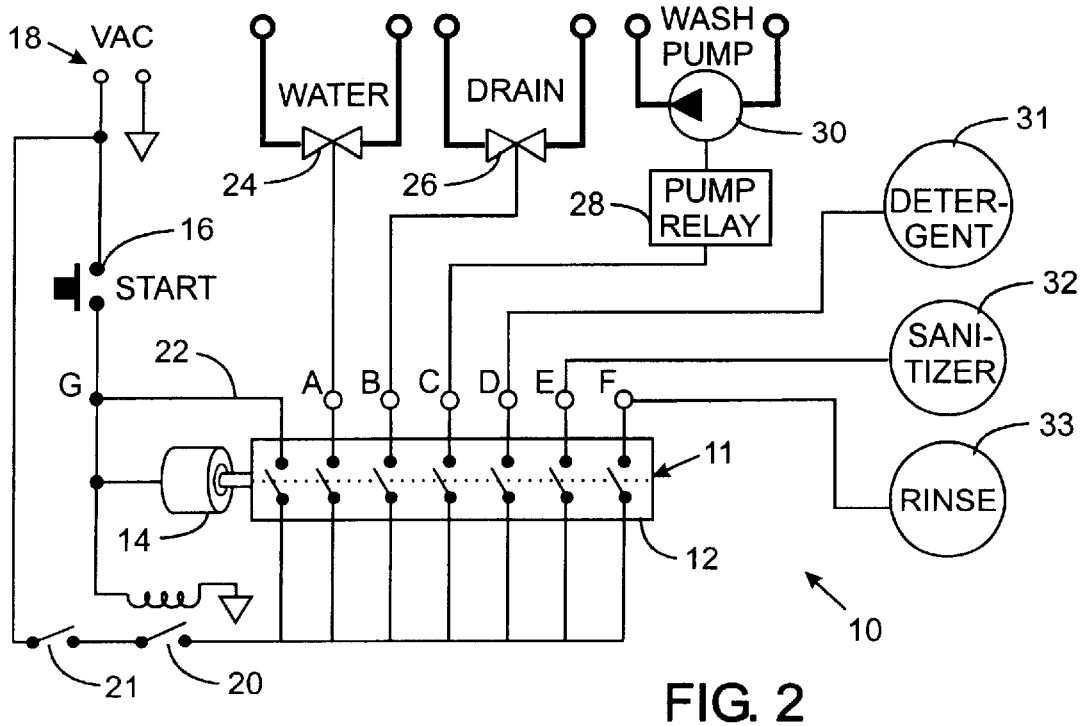
FIG. 2 is a schematic representation of conventional control circuitry for the commercial dishwasher.

Referring to FIG. 2, the dishwasher 5 has a conventional control system 10 that employs a standard timer 11 having a cam assembly 12 that is driven by a motor 14. The cam assembly 12 includes a plurality of lobes which selectively open and close a like plurality of switches that apply power to different components within the dishwasher. The speed of the motor and the shape of the cam assembly determine the sequence and periods that the components are activated during an operating cycle of the dishwasher. An operating cycle includes sub-cycles for washing, rinsing, and drying. A momentary start switch 16 applies power from a power line connection 18 to the motor 14 and to the coil of a main relay 20. This causes the timer 11 to advance and close a switch that applies power from the main relay 20 to a conductor 22 thereby sustaining operation of the timer motor 14 and maintaining the main relay closed. This switch within the timer 11 opens at the end of the operating cycle, thereby stopping the dishwasher until the start switch 16 is pressed again.

Another switch within the timer 11 is connected via terminal A to a solenoid valve 24 which controls flow of water to the dishwasher. A drain solenoid valve 26 is operated by a signal from a timer switch at terminal B to drain water from the dishwasher. Still another switch of the cam assembly 12 is coupled via terminal C to the coil of a pump relay 28 that applies electricity to a wash pump 30 which circulates water within the dishwasher through various spray nozzles and arms in the dishwasher cabinet 6. The timer switches connected to terminals D, E, and F respectively control pumps 31, 32, and 33 which add detergent and other chemicals during various stages of dishwasher operation.

Figure 3:
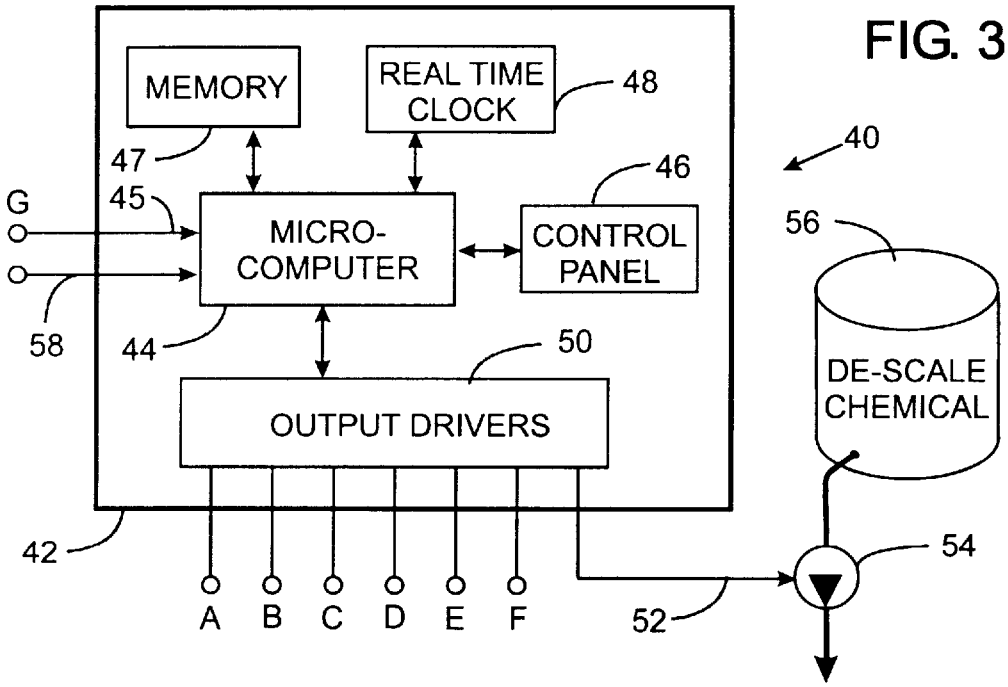
FIG. 3 is a schematic diagram of the components of the present invention.

The de-scaling apparatus 40 is connected to the conventional dishwasher control circuit to automatically operate the dishwasher through a special cycle which removes mineral deposits, such as lime scale. With reference to FIG. 3, the de-scaling apparatus 40 comprises a controller 42, a reservoir 56 containing a chemical solution that dissolves lime deposits, and a pump 54 which forces the chemical into the dishwasher chamber, as shown in FIG. 1. Alternatively, the pump 54 may be replaced by a solenoid valve in installations in which the chemical is able to flow by gravity from the reservoir 56 into the dishwasher. The a reservoir 56 contains a quantity of the chemical solution that is sufficient for numerous de-scaling procedures so that the procedure can occur automatically without having to manually add the cchemical each time.

The Controller 42 is built around a microcomputer 44 which executes a control program stored within a memory 46 to perform a sequence of steps of the de-scaling process. A control panel 46 enables the dishwasher operator or service technician to configure operation of the apparatus and the de-scaling procedure for the particular requirements of a specific dishwasher and water conditions. For example, the control panel is used to set the frequency at which the de-scaling process is performed. A real-time clock 48 provides information to microcomputer 44 regarding the date and time of day for use in determining when to commence the de-scaling process. The microcomputer 44 also has an input 45 which is connected to node G at the input to the timer motor 14. This provides a signal whenever the dishwasher is started and enables the microcomputer to count the number of operating cycles that occur since the last descaling procedure. This count can be compared to a user defined value to determine the amount of dishwasher usage and whether another descaling procedure should be commenced.

A plurality of output drivers 50 enable the microcomputer to operate the valves, relays, and other components of the dishwasher. Specifically, separate output drivers are provided to connect to terminals A–F of the dishwasher control circuit shown in FIG. 2 and selectively apply electrical current to those terminals. An additional output line 52 is connected to the pump 54 which draws the de-scale chemical from reservoir 56 and dispenses that chemical into the dishwasher, as will be described. Common de-scale chemical solutions incorporate hydrochloric or phosphoric acid.

As will be readily appreciated by those skilled in the art of control systems for appliances, the present descaling apparatus 40 may be provided for after-market connection to the control circuit of a conventional dishwasher, or the apparatus may be incorporated into a dishwasher by a manufacturer.

The dishwasher operator can configure the de-scaling system 40 to perform a de-scaling operation either on a periodic basis, as determined by the number of days indicated by the real-time clock 48, which have elapsed since a previous de-scaling operation, or every time a specified number of operating cycles has occurred. One of these options is selected via the control panel and the respective number of days or wash cycles is entered into the control panel. Other parameters that provide a measure of the amount of dishwasher use or scale build-up also may be used as the predefined event which indicates that a de-scaling operation should be performed.

Figure 4:
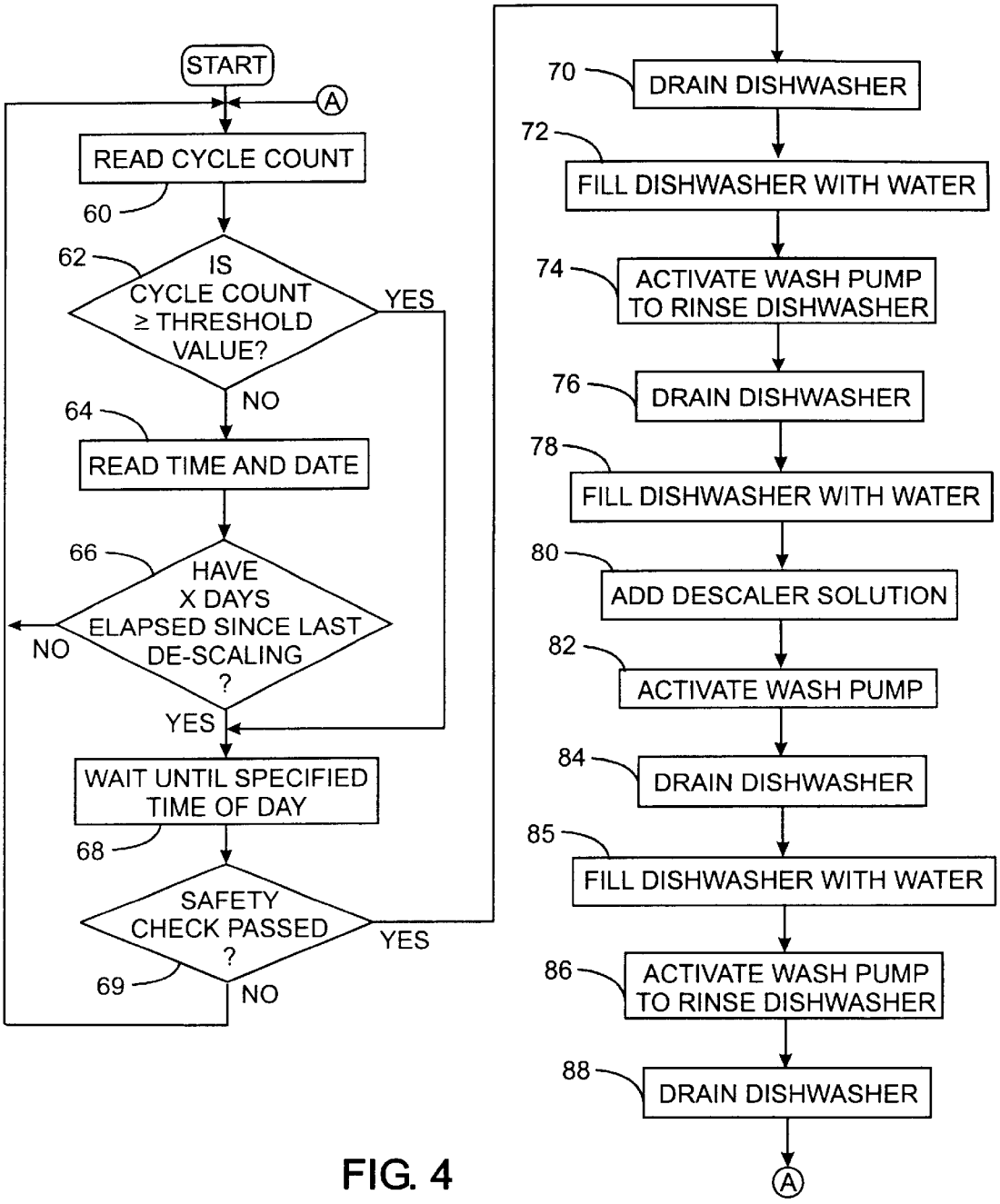
FIG. 4 is a flow chart of the de-scaling process according to the present invention.

With reference to FIG. 4, the microcomputer 44 periodically, such as in response to a timed interrupt, commences execution of a software routine which determines whether it is time to perform a descaling operation. This routine starts at step 60 where a count of dishwasher cycles is read from the memory 47. As mentioned previously, the microcomputer 44 receives a signal on input line 45 each time that the dishwasher is started and this enables the microcomputer to maintain a count of the dishwasher cycles, i.e. a cycle count. At step 62, the cycle count is compared to a threshold value which indicates how many dishwasher cycles should occur between descaling procedures. If this threshold number of cycles has occurred, execution of the software routine jumps to step 68, otherwise the execution advances to step 64. If a count of dishwasher cycles is not to be used to trigger the descaling operation, this threshold is set to a very large default value.

At step 64, the real time clock 48 is read to determine the number of days that have occurred since the previous de-scaling operation as an alternative trigger mechanism. This number of days is compared to a value X in the system's configuration data that indicates how often defined by a number of days the de-scaling procedure should take place. If this interval has not occurred the software routine terminates returns to step 60 to wait for the proper time to perform the de-scaling operation. If an elapsed time is not to be used to trigger the de-scaling operation, the threshold interval is set to a very large default value.

When either step 62 or step 66 indicates that it is time to perform the de-scaling operation, the software execution advances to step 68. The de-scaling procedure may operate for up to an hour, during which time dishes and other kitchen ware cannot be cleaned by the dishwasher. As a consequence, the de-scaling operation does not occur immediately when the microcomputer 44 determines that the requisite number of wash cycles or days has elapsed. Instead the de-scaling process is scheduled for a user defined time of day when the dishwasher normally will not be in use, for example 3:00 a.m. Therefore, the software execution waits at step 68 for that time of day, at which point the system performs a safety check at step 69 to ensure that the de-scaling operation can occur without adverse consequences. Specifically, the microcomputer 44 examines the signal on input line 45 to determine if the dishwasher is currently operating. The de-scaling solution may react with conventional dishwashing chemicals and create toxic gases. Therefore, if the dishwasher is currently operating the descaling procedure will not occur and the procedure returns to step 60. In addition, the de-scaling operation will not commence if the doors 8 of the dishwasher has been left open. Present day dishwashers have a door interlock switch 21 in series with the main relay 20 which prevents the dishwasher from operating with the doors open. If the de-scaling apparatus 40 is installed on an older dishwasher that does not have a door interlock switch 21, that type of switch will be installed and connected to input 58 of the microcomputer 44. If this input indicates that the doors 8 are open, the descaling procedure will not occur.

Assuming that the system passes the safety checks, the de-scaling operation commences at step 70 with the microcomputer 44 commanding one of the output drivers 50 to energize the solenoid of the drain valve 26 via the output line connected to terminal B. The drain valve 26 is maintained in an open state for a period of time that is sufficiently long to enable any residual water in the dishwasher to flow to a waste pipe in the building. During the entire de-scaling process, an indicator light on the control panel 46 flashes to provide a visual indication of this operation to kitchen personal.

The process then advances to step 72 where the drain valve 26 is closed by de-energizing its solenoid and the water valve 24 is opened by an output driver 50 of the descaling apparatus applying electric current to terminal A in the dishwasher control circuit 10. The water valve 24 is held open long enough for the dishwasher to fill with the normal amount of water for a rinse cycle. That interval and other intervals are user definable during configuration of the descaling apparatus to conform to the operation of the dishwasher. The microcomputer 44 then commands the output driver to apply electricity to terminal C which activates the wash pump 30 at step 74. This action causes the water in the dishwasher to be pumped through the various spray jets and arms thereby rinsing any residual chemicals to the bottom of the dishwasher chamber. For example, the wash pump may be activated for 15 seconds to complete the rinse operation. Thereafter the drain valve 26 is opened again at step 76 to remove the rinse water from the dishwasher. This rinsing prevents the chemical used in dishwashing from reacting with the descaling chemical.

The de-liming process advances to step 78 where the water valve 24 is opened again to fill the dishwasher with clean water. While this is occurring, or immediately thereafter, the pump 54 is energized via an output driver 50 connected to line 52 to inject a quantity of the de-scale chemical from reservoir 56 into the dishwasher chamber, at step 80. The pump 54 is energized for a defined amount of time that corresponds to the quantity of chemical to be added as defined by configuration of the apparatus 40. Thereafter, the water valve 24 and the chemical pump 54 are deactivated.

Next, at step 82, the microcomputer 44 energizes the wash pump 30 by a command to the output driver 50 connected to terminal C. This causes the wash pump 30 to circulate the mixture of water and de-scale chemical through the various jets and arms of the dishwasher. This not only cleans those fluid conduits, but also circulates the de-lime chemical solution throughout the chamber of the dishwasher. The operation of the wash pump 30 continues for a given period of time which is user configurable and is based upon the amount of lime scale that normally builds up between de-scaling operations. After the predefined de-scaling period, the microcomputer 44 opens the drain valve 26 to remove the mixture of water and de-scale chemical mixture from the dishwasher at step 84.

Next, the dishwasher is filled again with water at step 85 by opening the solenoid operated water valve 24 for a defined period of time. Once filled with fresh water, the process advances to step 86 where the wash pump 30 is energized by the controller 40 to rinse all of the components within the dishwasher. After a 15 second rinse period, the wash pump 30 is de-energized and the drain valve 26 is opened at step 88 to drain the machine. After a sufficiently long period to allow all of the water to have drained from the dishwasher, the microcomputer 44 closes the drain valve 26 and terminates the de-scaling procedure by returning to step 60.

The rinse cycles at the beginning and end of the de-scaling procedure, eliminate the possibility that the acidic de-scaling chemical reacts with bleach or other chemicals used in washing kitchen ware, which could produce toxic gases.

The present apparatus is completely configurable both in terms of the frequency at which the de-scaling operation occurs, and periods that the dishwasher components operate during the de-scaling procedure. The de-scaling procedure may occur on a timed basis, once every so many days, or based on a number of wash cycles which have occurred since the prior de-scaling operation. Furthermore, the present system allows the de-scaling procedure to occur after regular business hours when normal operation of the dishwasher is unlikely. The automatic nature of the process ensures that de-scaling will occur and not be dependant upon observation and memory of kitchen personnel.

What is claimed is:

1. An apparatus for automatically removing mineral deposits from an interior of a dishwasher, wherein the dishwasher has a water valve, a drain valve, and a wash pump, said apparatus comprising:

a mechanism which determines when to commence a descaling operation, wherein the mechanism comprises either a clock apparatus which produces a descaling indication upon a given amount of time elapsing since a previous removal mineral deposits from the dishwasher or a counter which produces the descaling indication upon the occurrence of a predefined number of operating cycles of the dishwasher;

a reservoir for containing a chemical which cleanses mineral deposits from surfaces of objects;

a flow control device which couples the reservoir to the dishwasher and controls a flow of the chemical into the dishwasher; and a controller connected to the water valve, the drain valve, the wash pump and the control device, wherein the controller responds to the descaling indication by operating the water valve and the control device to introduce water and the chemical into the dishwasher, activates the wash pump to circulate a mixture of water and the chemical inside the dishwasher, and thereafter opens thc drain valve to remove the mixture from the dishwasher.

2. The apparatus as recited in claim 1 wherein the control device is a pump.

3. The apparatus as recited in claim 1 wherein the control device is a valve.

4. The apparatus as recited in claim 1 wherein after the controller opens the drain valve to remove the mixture from the dishwasher, the controller operates the water valve, the drain valve and the wash pump to rinse the interior of the dishwasher.

5. The apparatus as recited in claim 1 wherein in response to the descaling indication, the controller operates the water valve, the drain valve and the wash pump to rinse the interior of the dishwasher, before the controller operates the water valve and the control device to introduce water and the chemical into the dishwasher.

6. The apparatus as recited in claim 1 further comprising a chemical within the reservoir which cleanses mineral deposits from surfaces of objects.

7. An apparatus for automatically removing mineral deposits from an interior of a dishwasher, wherein the dishwasher has a water valve, a drain valve, and a wash pump, said apparatus comprising:

a mechanism which determines when to remove mineral deposits, wherein the mechanism comprises either a clock apparatus which produces a descaling indication upon a given amount of time elapsing since a previous removal mineral deposits from the dishwasher or a counter which produces the descaling indication upon the occurrence of a predefined number of operating cycles of the dishwasher;

a reservoir for containing a chemical which cleanses mineral deposits from surfaces of objects;

a flow control device which couples the reservoir to the dishwasher and controls a flow of the chemical into the dishwasher in response to an electrical signal;

an electrical controller connected to the water valve, the drain valve, the wash pump and the control device, wherein the controller responds to the descaling indication by operating a descaling procedure by (1) operating the water valve, the drain valve and the wash pump to rinse the interior of the dishwasher, (2) then operating the water valve and the control device to introduce water and the chemical into the dishwasher, activating the wash pump to spray a mixture of water and the chemical inside the dishwasher, followed by opening the drain valve to remove the mixture from the dishwasher, and (3) thereafter operating the water valve, the drain valve and the wash pump to rinse the interior of the dishwasher.

8. The apparatus recited in claim 7 wherein the control device is a pump.

9. The apparatus recited in claim 7 wherein the control device is a valve.

10. A dishwasher comprising;

a cabinet defining a chamber into which dishes are loaded for washing;

a washing and rinsing apparatus in the chamber;

a water valve which controls a flow of water from a supply into the chamber; a drain valve which controls a flow of water from the chamber to a drain line;

a wash pump for circulating water through the washing and rinsing apparatus;

a mechanism which determines when to remove mineral deposits from the chamber, wherein the mechanism comprises either a clock apparatus which produces a descaling indication upon a given amount of time elapsing since a previous removal mineral deposits from the chamber or a counter which produces the descaling indication upon the occurrence of a predefined number of operating cycles of the chamber;

a reservoir for containing a chemical which cleanses mineral deposits from surfaces of objects;

a flow control device which couples the reservoir to the chamber and controls a flow of the chemical there between; and a controller connected to the water valve, the drain valve, the wash pump and the control device, wherein the controller responds to the descaling indication by operating the water valve and the control device to introduce water and the chemical into the chamber, activates the wash pump to circulate a mixture of water and the chemical inside the chamber, and thereafter opens the drain valve to remove the mixture from the dishwasher.

11. A method for automatically removing mineral deposits from an interior of a dishwasher, said method comprising:

providing a reservoir that contains a chemical which cleanses mineral deposits from surfaces of objects;

connecting the reservoir by a flow control device to the dishwasher, wherein the flow control device selectively regulates flow of the chemical into the dishwasher;

determining an occurrence of a predefined event which indicates that time has come to remove mineral deposits from the dishwasher; and in response to that occurrence:

(a) operating the water valve and the control device to introduce water and the chemical into the dishwasher;

(b) activating the wash pump to spray a mixture of water and the chemical inside the dishwasher; and (c) operating the drain valve to remove the mixture from the dishwasher.

12. The method as recited in claim 11 wherein determining an occurrence of a predefined event comprises measuring usage of the dishwasher; and determining that the predefined event has occurred when the usage reaches a predefined level.

13. The method as recited in claim 11 wherein determining an occurrence of a predefined event comprises counting when the dishwasher is operated, thereby producing a count; and determining that the predefined event has occurred when the count reaches a predefined value.

14. The method as recited in claim 11 wherein determining an occurrence of a predefined event comprises determining that a predefined amount of time has elapsed since a previous removal of mineral deposits from the dishwasher.

15. The method as recited in claim 11 further comprising, prior to operating the water valve and the control device to introduce water and the chemical into the dishwasher, operating the water valve and the wash pump to rinse the interior of the dishwasher.

16. The method as recited in claim 15 further comprising, after the interior of the dishwasher has been rinsed, operating the drain valve to remove rinse water from the dishwasher.

17. The method as recited in claim 11 further comprising, after, operating the drain valve to remove the mixture from the dishwasher, operating the water valve and the wash pump to rinse the interior of the dishwasher.

18. The method as recited in claim 17 further comprising, after the interior of the dishwasher has been rinsed, operating the drain valve to remove rinse water from the dishwasher.

* * * * *